US006220144B1

(12) United States Patent
Manring et al.

(10) Patent No.: US 6,220,144 B1
(45) Date of Patent: Apr. 24, 2001

(54) EXTENDED SLIPPER FOR HYDROSTATIC PUMP AND MOTOR ROTATING CYLINDERS

(75) Inventors: Noah Manring, Roland, IA (US); Jaroslav Ivantysyn, Schleswig-Holstein (DE)

(73) Assignee: Sauer Inc., Ames, IA (US)

( * ) Notice: Subject to any disclaimer, the term of this patent is extended or adjusted under 35 U.S.C. 154(b) by 0 days.

(21) Appl. No.: 09/387,872

(22) Filed: Jun. 3, 1997

Related U.S. Application Data

(63) Continuation of application No. 08/582,656, filed on Jan. 4, 1996, now abandoned.

(51) Int. Cl.[7] ..... F01B 13/04; F01B 3/00
(52) U.S. Cl. ..... 92/57; 92/71
(58) Field of Search ..... 91/499; 92/12.2, 92/57, 71; 417/269; 74/60

(56) References Cited

U.S. PATENT DOCUMENTS

| | | |
|---|---|---|
| 932,033 | 7/1909 | Krone . |
| 1,137,283 | 4/1915 | Pratt . |
| 1,159,980 | 11/1915 | Moreno . |
| 1,263,180 | 4/1918 | Williams . |
| 1,533,399 | 4/1925 | Dunlap . |
| 1,710,567 | 4/1929 | Carey . |
| 2,220,636 | 11/1940 | Bischof . |
| 2,277,496 | 3/1942 | Maines . |
| 2,608,159 | 8/1952 | Born . |
| 2,891,419 | 6/1959 | Badalini . |
| 3,120,816 | 2/1964 | Firth et al. . |
| 3,142,262 | 7/1964 | Firth et al. . |
| 3,159,041 | 12/1964 | Firth et al. . |
| 3,424,097 | 1/1969 | Molly . |
| 4,037,521 | 7/1977 | McLeod . |
| 5,070,765 | 12/1991 | Parsons . |

FOREIGN PATENT DOCUMENTS

| | | |
|---|---|---|
| 1 269 494 | 5/1968 | (DE) . |

*Primary Examiner*—F. Daniel Lopez
(74) *Attorney, Agent, or Firm*—Zarley, McKee, Thomte, Voorhees & Sease

(57) ABSTRACT

A cylinder block for a hydrostatic transmission has a rotatable piston housing with a plurality of piston bores arranged in a circular pattern in the housing. A piston element is slidably mounted in each bore. Each of the piston elements has an outer end extendible out of an open end of each of the bores. A well or socket having a rounded bottom portion is in the outer end of each of the pistons. A piston slipper element comprising an arcuate base (a ball) is rotatably mounted in the socket. An arm extends outwardly from the ball and has a laterally extending flat planar surface at the other end. The flat planar surface slidably engages a swashplate having a planar control surface. The distance from the center of the ball to the flat planar surface is greater than the diameter of the piston element.

7 Claims, 4 Drawing Sheets

EXTENDED SLIPPER FOR HYDROSTATIC PUMP AND MOTOR ROTATING CYLINDERS

This is a continuation of copending application Ser. No. 08/582,656 filed on Jan. 4, 1996.

BACKGROUND OF THE INVENTION

Hydrostatic transmissions have two or more hydrostatic units utilizing rotating cylinder blocks of similar construction that are hydraulically connected. One cylinder block, normally referred to as the pump, is connected to a rotatable input shaft, and the other cylinder block, referred to as a motor, has a power output shaft. These cylinder blocks or groups typically are of the piston/swashplate design or are of a bent-axis design. Each of these designs have certain beneficial design features, but both also have certain structural and functional shortcomings. This invention combines the best of these two designs, and substantially eliminates the shortcomings of each. Further advantages are realized by this invention that are not present in either of the prior designs.

Specifically, the ball and socket joint at the piston/slipper interface was characteristic of both bent-axis and swashplate designs. An extended arm that reaches toward and sometimes inside the piston bore was characteristic of only the bent-axis design. A hydrostatic bearing-surface that slides between the slipper and the swashplate was characteristic of the swashplate design.

The prior swashplate designs had substantial side-load on the pistons creating greater friction between the pistons and bores, which adversely affected torque efficiency. Only low swashplate angles were available which limited power output. The load carrying point of the shaft (i.e., the "sweet spot") was located by the length of the cylinder in a position which invited failure at the interface between the cylinder block and the shaft. The greater length of existing blocks required a longer shaft which invited shaft deflection which reduced the life of shaft bearings.

Therefore, a principal object of this invention is to provide a rotating cylinder for a swashplate-type hydrostatic transmission that will create a substantial reduction in piston surface pressure between the pistons of the cylinder and the piston bores, and to thereby improve the torque efficiency of the machine being driven by the transmission.

A further object of this invention is to provide a rotating cylinder for a swashplate-type hydrostatic transmission wherein higher swashplate angles are achievable to improve power output and overall efficiency of the machine.

A still further object of this invention is to provide a rotating cylinder for swashplate-type hydrostatic transmissions which moves the load-carrying point of the shaft closer to the valve plate end of the cylinder block to increase the strength of the interface between the cylinder block and the shaft to prevent failure of the interface.

A still further object of this invention is to provide a rotating cylinder block for swashplate-type hydrostatic transmissions which will have a sweet spot closer to the valve plate end of the cylinder block, and which will reduce the overhang length of the piston, which allows for a reduction in the overall length of the machine package.

A still further object of this invention is to provide a rotating cylinder for a swashplate-type hydrostatic transmission which will permit a reduction in the length of the shaft which in turn will increase the bearing life for the shaft bearings.

These and other objects will be apparent to those skilled in the art.

SUMMARY OF THE INVENTION

The cylinder block for hydrostatic transmission of this invention has a rotatable piston housing with a plurality of piston bores arranged in a circular pattern in the housing. A piston element is slidably mounted in each bore. Each of the piston elements has an outer end extendible out of an open end of each of the bores. A well or socket having a rounded bottom portion is in the outer end of each of the pistons. A piston slipper element comprising an arcuate base (a ball) is rotatably mounted in the socket. An arm extends outwardly from the ball and has a laterally extending flat planar surface at the other end. The flat planar surface slidably engages a swashplate having a planar control surface.

DESCRIPTION OF THE PREFERRED EMBODIMENT

Figure 1:
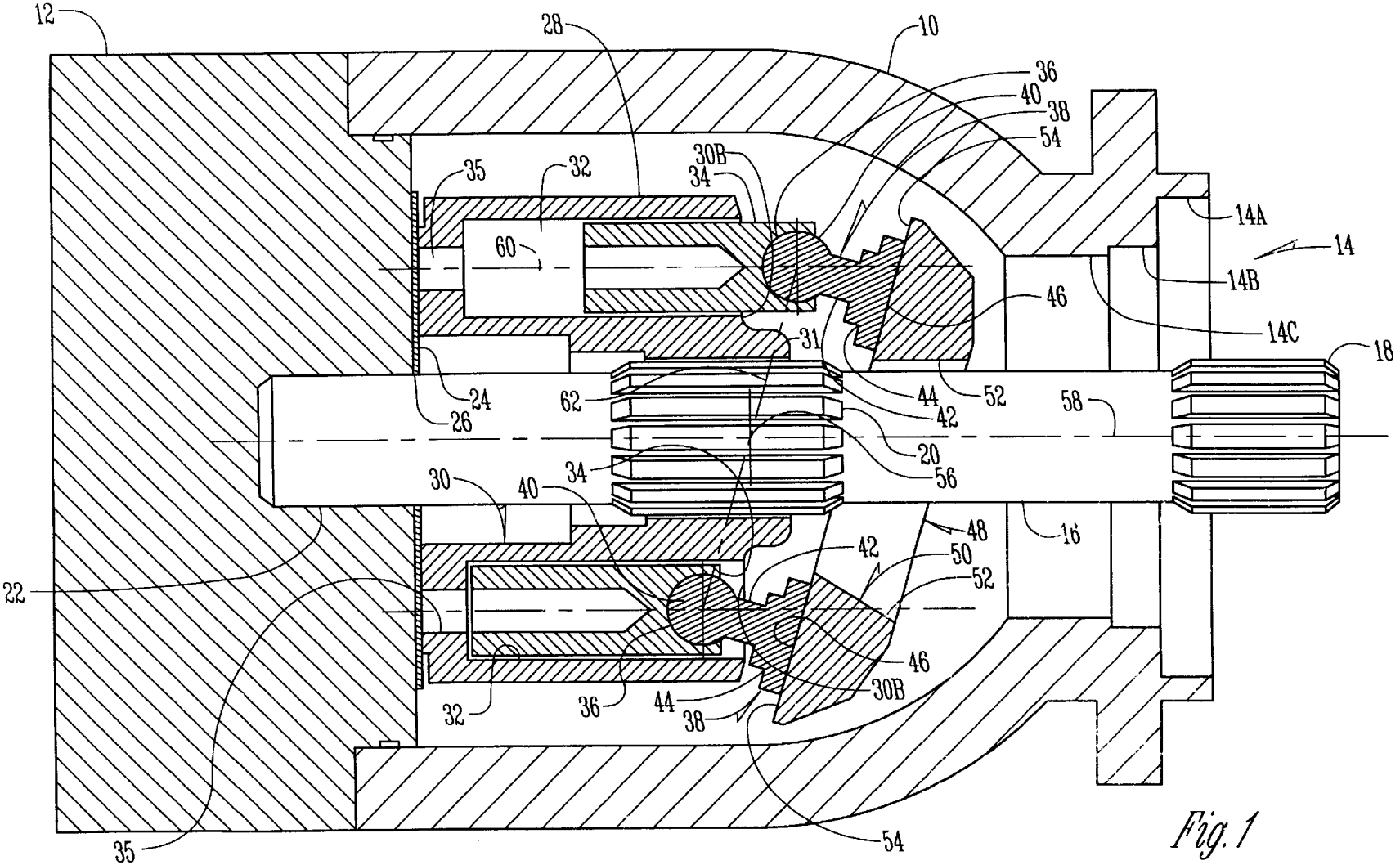
FIG. 1 is a longitudinal sectional view through the cylinder block of this invention.

With reference to FIG. 1, the numeral 10 designates a cylinder block housing having an end cap or center section 12 at one end thereof. The conventional fluid conduits in member 12 have not been shown but are well understood in the art. See U.S. Pat. No. 5,218,886. The other end of member 10 has a center opening 14 with areas 14A, 14B and 14C to receive conventional bearings, seals or the like. A shaft 16 extends inwardly into housing 10 through opening 14. Shaft 16 has conventional connection 18 to be attached to a source or recipient of rotational power (not shown). Splines 20 on the center portion of shaft 16 serve to power or rotate the cylinder block of this invention as will be discussed hereafter. A bearing socket 22 appears in member 12 and receives the inner end of shaft 16. Appropriate bearings (not shown) can be utilized in conjunction with the bearing socket 22 as required. A conventional valve plate 24 is placed on the member 12 and has suitable ports therein (not shown) which are well known in the art to service the components in the cylinder block housing 10. The valve plate 24 has a center opening 26 to accommodate shaft 16.

The numeral 28 designates a cylinder block which has a splined hub 30 in its center portion adapted to slidably receive, for assembly purposes, the splines 20 on shaft 16. Hub 30 has an outer end with a shoulder 31 of reduced outer diameter (FIG. 1). The inter-connection between the splined hub 30 and the splines 20 permit the shaft 16 to rotate the cylinder block 28 as is conventional.

Cylinder block 28 has a plurality of cylindrical bores 32 each of which has a piston 34 slidably mounted therein. The length of the bores 32 is greater than the length of pistons 34. A conduit 35 at the inner end of each of the bores 34 serves to permit hydraulic fluid to be in communication with the bottoms of the bores 32. The conduits 35 are in communication with appropriate conduits in the member 12 for the supply of hydraulic fluid to the piston bores 32. Spherical-shaped wells or sockets 36 are formed in the outer end of each of the pistons 34.

Slipper elements 38 are comprised of spherical balls 40 which are rotatably inserted in the sockets 36. Arms 42 extend outwardly from balls 40 and terminate in slide elements 44 which have a flat planar surface 46.

Swashplate 48 is conventionally mounted in housing 10 and has a center opening 50 to receive shaft 16 and to permit the swashplate to be angularly moved, if required, within housing 10 with sufficient clearance so as not to impinge on shaft 16. Center opening 50 has a peripheral tapered wall 52 which serves to further permit the swashplate to be angularly disposed with respect to shaft 16 without touching shaft 16. The swashplate 48 is of solid construction and has an inner flat planar surface 54 that engages the flat planar surface 46 on slipper elements 38 as discussed heretofore.

It should be noted that the slipper elements 38, depending upon the angular position of swashplate 48, are able to extend into the cylinder bores 32 primarily because of the length of the arms 42 which are a part of the slipper elements. This arrangement of structure permits the swashplate 48 to assume a greater angular position with respect to shaft 16 than would otherwise be the case. Further, this arrangement of structure results in a cylinder block 28 of a shorter length than would otherwise be the case. In addition, the sweet spot 56, which is the point of maximum concentration of lateral or side forces within the device is moved in a direction closer to valve plate 24 within the body of cylinder block 28. This results in a structurally superior cylinder block as compared to a sweet spot that was further removed from the valve plate 24.

The numeral 58 designates the center axis of the housing 10, block 28 and shaft 16. The numeral 60 designates the center axis of the bores 32 and pistons 34. The line 62 is an imaginary line between the center of balls 40. The sweet spot 56 is located within block 28 and is at the intersection of line 62 and axis 58.

By more centralizing the side load forces between the shaft 16 and the cylinder block 28 (by moving the sweet spot 56 further into the cylinder block 28 as discussed above) a substantial reduction in the surface pressure on the pistons 34 is achieved. This results in less friction between the pistons and the piston bores 32.

The higher swashplate angles which are achievable by this structure, as discussed above, improves the power output and the overall efficiency of the transmission. Further, the higher swashplate angles give the variable motor a great stroking ratio from maximum stroke to minimum stroke. This advantage is available for both the pumps and the motors.

A further advantage of moving the sweet spot 56 further into the body of the cylinder block 28 is that it increases the strength of the interface between the splined hub 30 of the cylinder block and the splines 20 of shaft 16. This is a very significant improvement of the invention since this interface in prior art devices is notorious for failure.

The position of the sweet spot 56 as described above, in combination with the reduction of the overhang length of the piston results in a significant potential for reducing the overall length of the machine package. It has been demonstrated in models of this invention that the overall length of the cylinder block can be reduced by 1.5 inches. By this reduction in length, the length of the shaft 16 is also reduced. This reduces the possibility of shaft deflections which in turn would increase the bearing life of bearings supporting the shaft.

Figure 3:
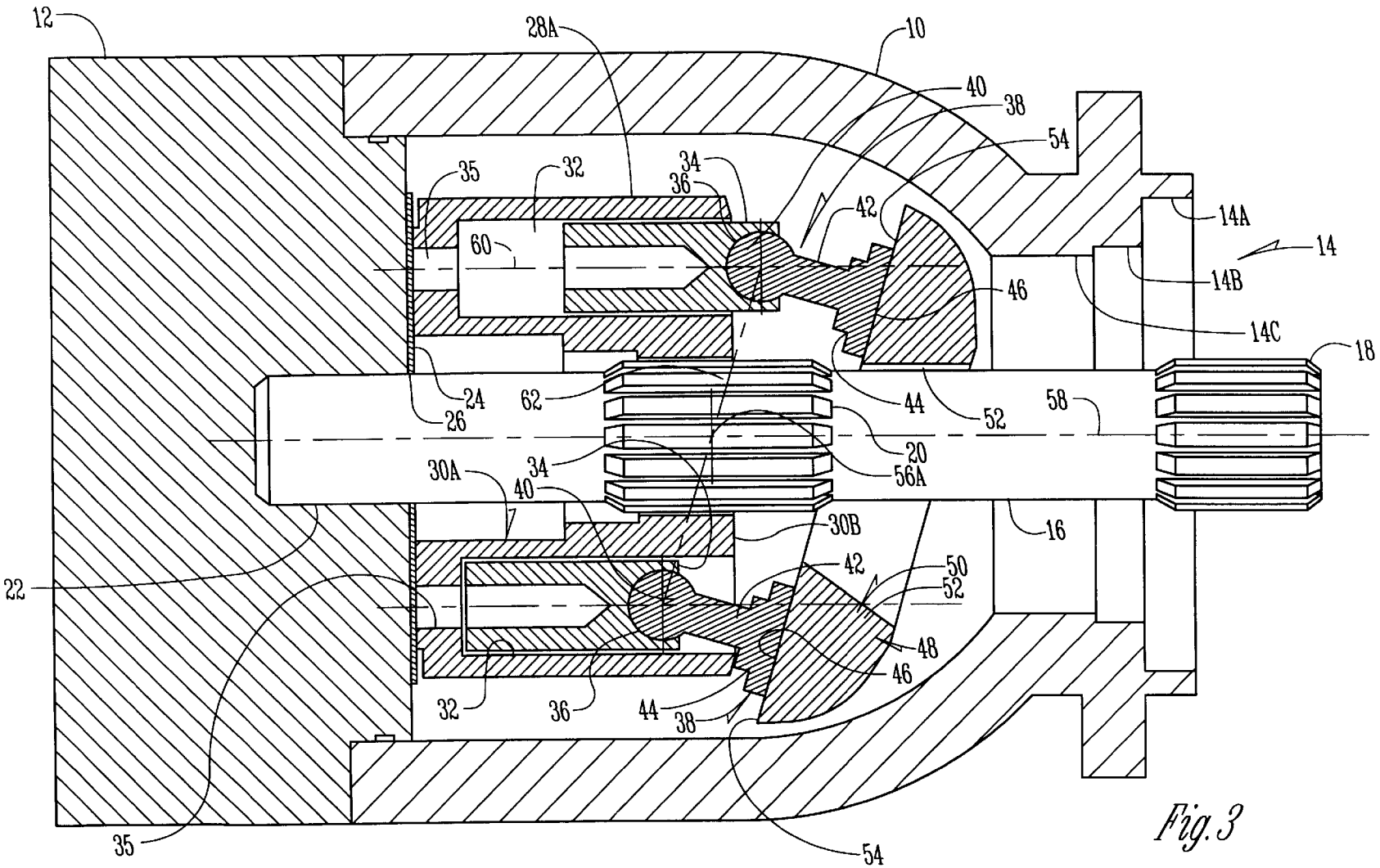
FIG. 3 is a drawing similar to that of FIG. 1 showing a modified form of the invention.

FIG. 3 shows a structure very similar to that of FIG. 1, and like reference numerals are shown in each drawing, except that the shoulder 31 on hub 30 of FIG. 1 has been eliminated on hub 30A in FIG. 3. This is because the arms 42 on slipper elements 38 are longer in FIG. 3 than in FIG. 1. This allows the swashplate 48 in FIG. 3 to be displaced at a greater angle with respect to axis 58, thus moving the sweet spot 56A in FIG. 3 closer to valve plate 24 than is the sweet spot 56 in FIG. 1. With the sweet spot located "deeper" into the cylindrical block as shown in FIG. 3, the shoulder 31 can be eliminated.

Figure 4:
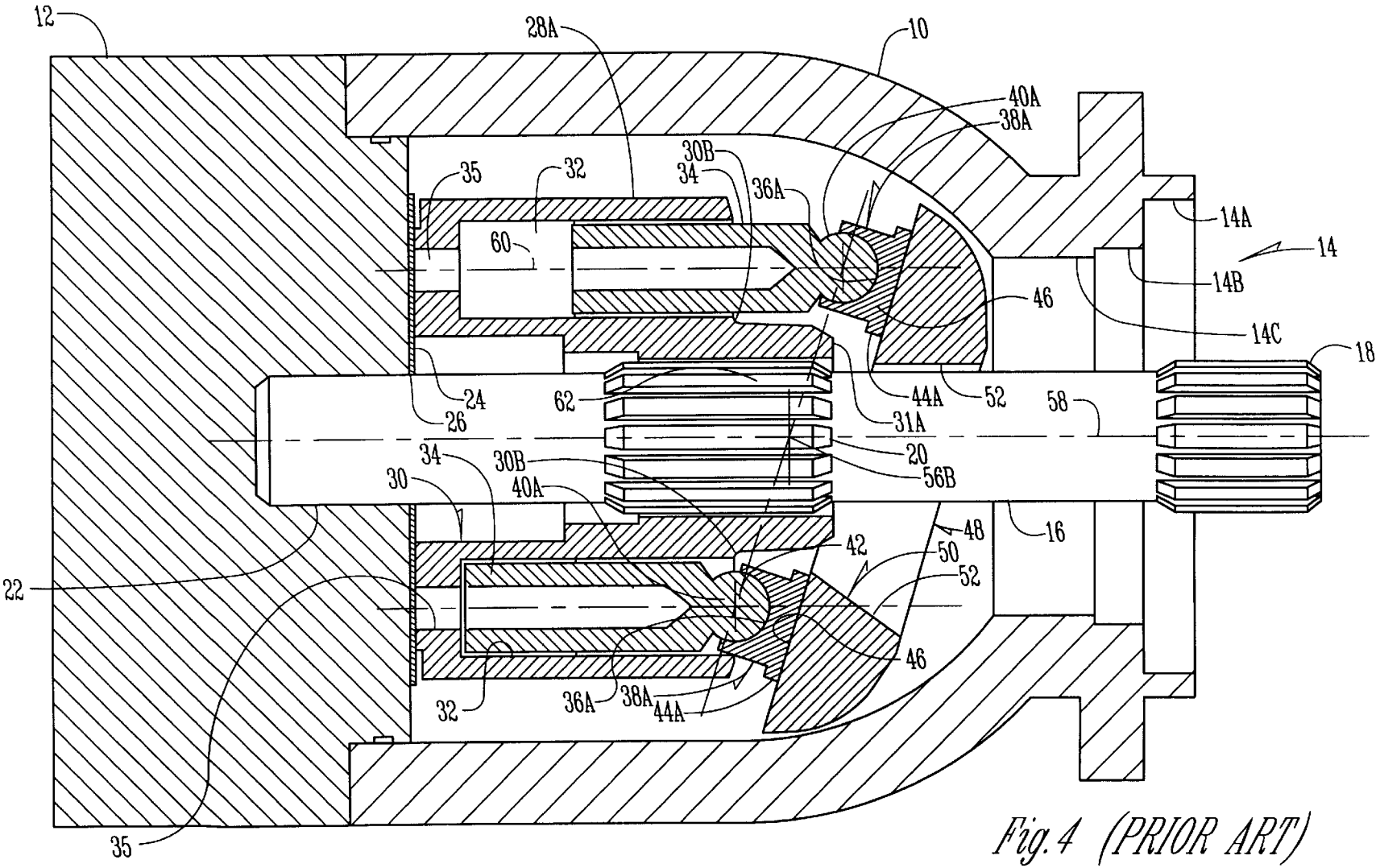
Fig. 4 (PRIOR ART)
FIG. 4 is a drawing of a prior art configuration.

Both the devices of FIGS. 1 and 3 are an improvement over the prior art device of FIG. 4 which shows cylinder block 28A with shoulder 31A on hub 30 which is substantially "longer" than the shorter shoulder 31 of FIG. 1. Shoulder 31 is very susceptible to damage because the sweet spot 56B of the device of FIG. 4 is substantially beyond the end of hub 30. Also, the hub 30 of FIG. 3 is easier to fabricate than either of the hubs 30 of FIG. 1 or 4. The hub 30 and shoulder 31 of FIG. 1 is an improvement over that of FIG. 4 because shoulder 31 of FIG. 1 is shorter, and hence stronger, than the hub 31A of FIG. 4. The advantages of the device of FIGS. 1 and 3 over that of FIG. 4 reside in the movement of the sweet spots of FIGS. 1 and 3 in a direction towards valve plate 24.

Further, the device of FIGS. 1 and 3 permit a greater range of inclination for the swashplate with respect to axis 58 which provides for a greater range of speeds to be produced. Heretofore, an inclination of 25° of the swashplate was attainable only through an expensive bent axis arrangement. (See U.S. Pat. No. 1,137,283). The structure of FIG. 1 permits more swashplate inclination than that of FIG. 4, and FIG. 3 permits inclination very close to 25°.

It should be noted that the slippers 38A of FIG. 4 shows balls 40A integral with pistons 34. Balls 40A rotatably meet in sockets 36A in slide elements 44A.

Figure 2:
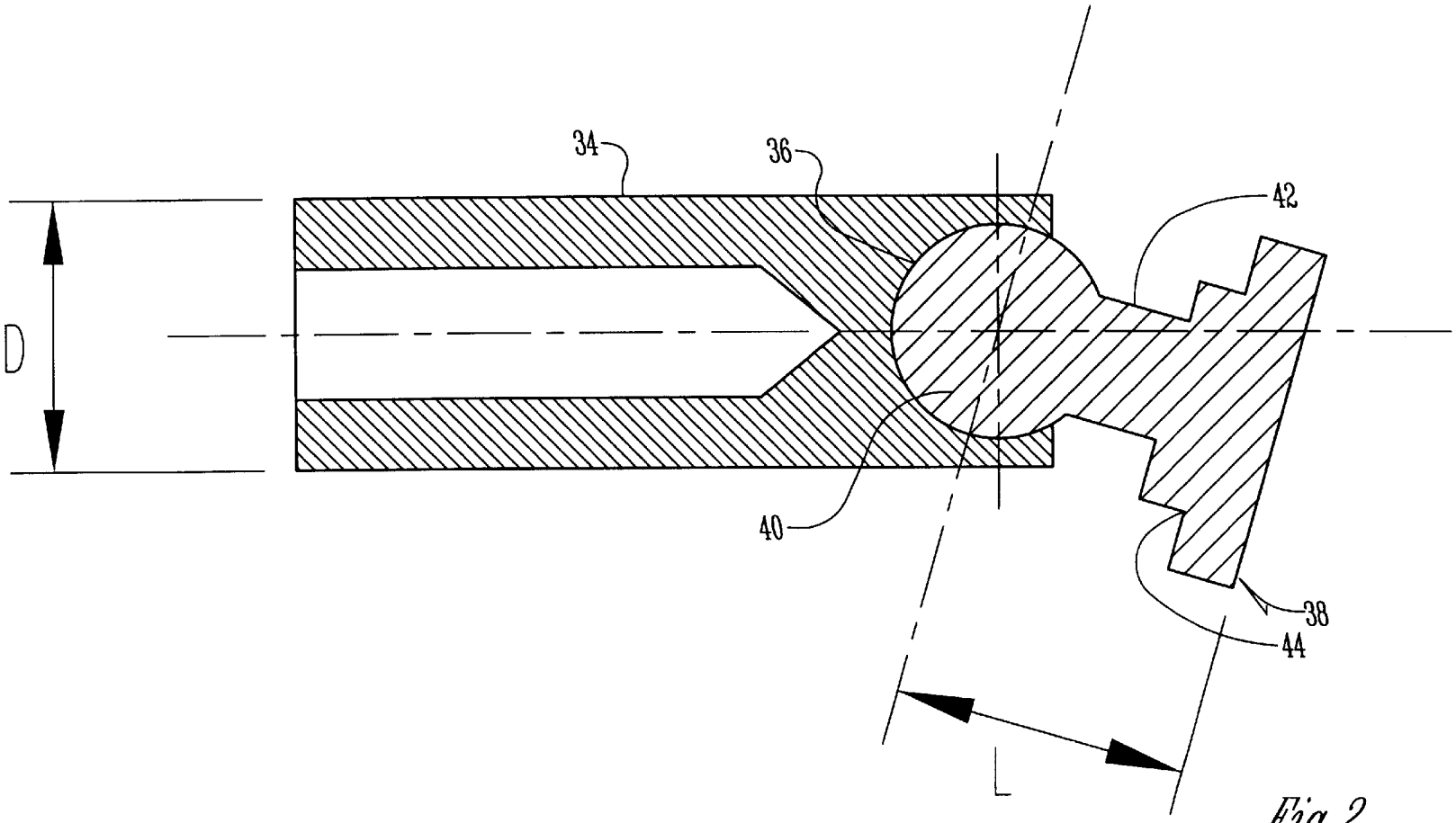
FIG. 2 is a schematic drawing similar to FIG. 1 showing the dimensional relationship between the length of the slipper and the diameter of the piston.

FIG. 2 shows the preferred dimensional relationship between the diameter of pistons 34 and the effective length of slippers 38 as measured from the geometric center of balls 40 to flat surface 46. The length L of slipper 38 is greater than the piston diameter D.

From the foregoing, it is seen that this invention will achieve at least its stated objectives.

What is claimed is:

1. A hydrostatic unit, comprising, a rotatable piston block, a plurality of parallel cylinder bores having an open end arranged in a circular pattern in said block, a piston element slidably mounted in each of said bores so as to axially reciprocate between a fully retracted position and a fully extended position, each of said piston elements having an outer end extendible beyond the open end of said bores, a well having a rounded bottom portion in the outer end of each of said pistons, a piston slipper element comprising an arcuate base rotatably dwelling in said well, and including an arm extending outwardly from said base, said arm connected at one end to said base and having a laterally extending flat planar surface at an end distal from the base, a swashplate having a flat planar control surface in engagement with the flat planar surface on said arm;

said piston slipper element having a spherical ball movably mounted in said well;

a distance from a center of said ball to said flat planar surface being greater than an outermost diameter of said piston element; and said center of said ball residing outside of said block at said fully extended position of said piston element.

2. The device of claim 1 wherein the piston slipper elements are T-shaped.

3. The device of claim 1 wherein said cylinder block has a longitudinal axis and said swashplate can be angularly disposed to said axis, and wherein said arms have a length sufficient to partially extend into the open end of said bores when said swashplate is angularly disposed to said axis and when the piston supporting said arm is withdrawn into the bore in which it is mounted a spaced distance from the open end of the bore.

4. The device of claim 1 wherein a shaft extends into said cylinder block and has an axis of rotation on the longitudinal axis of said cylinder block, and where said shaft is operatively connected to said cylinder block to rotate the same, and where said cylinder block has a point of concentrated side load forces at a load point defined by the intersection of the axis of rotation of said shaft and a straight line passing between the centers of said balls, with said load point located within said cylinder block.

5. The device of claim 4 wherein said cylinder block has an outer end dwelling substantially in a flat plane, and said load point is positioned within said cylinder block inwardly of said outer end.

6. The device of claim 1 wherein said laterally extending flat planar surfaces of said piston slipper element each have an area substantially greater than the cross-sectional area defined by a plane passing through the center of said balls.

7. The device of claim 1 wherein said piston element has a length less than that of said bores.

* * * * *